US007274031B2

(12) United States Patent
Smith

(10) Patent No.: US 7,274,031 B2
(45) Date of Patent: Sep. 25, 2007

(54) RADIATION SHIELDING

(75) Inventor: David M. Smith, Hampton, VA (US)

(73) Assignee: Northrop Grumman Corporation, Newport News, VA (US)

( * ) Notice: Subject to any disclaimer, the term of this patent is extended or adjusted under 35 U.S.C. 154(b) by 0 days.

(21) Appl. No.: 10/095,023

(22) Filed: Mar. 12, 2002

(65) Prior Publication Data

US 2002/0179860 A1 Dec. 5, 2002

Related U.S. Application Data

(63) Continuation-in-part of application No. 09/803,035, filed on Mar. 12, 2001, now abandoned.

(51) Int. Cl.
*H01B 1/00* (2006.01)

(52) U.S. Cl. ..... 250/515.1; 428/323; 252/510; 252/511; 252/500

(58) Field of Classification Search ..... 250/515.1, 250/506.1, 505.1, 519.1; 376/272; 252/500, 252/575, 515, 510, 511, 512, 513; 428/220, 428/328, 323, 480
See application file for complete search history.

(56) References Cited

U.S. PATENT DOCUMENTS 3,536,920 A 10/1970 Sedlak et al.
4,375,523 A 3/1983 Hatanaka et al.
4,575,578 A 3/1986 Bogan et al.
4,923,741 A 5/1990 Kosmo et al.
5,001,354 A 3/1991 Gould et al.
5,278,219 A * 1/1994 Lilley et al. ..... 524/439
5,366,664 A 11/1994 Varadan et al.
5,379,332 A 1/1995 Jacobson
5,523,581 A 6/1996 Cadwalader
5,525,408 A 6/1996 Weir et al.
5,548,125 A 8/1996 Sandbank
5,578,359 A 11/1996 Forbes et al.
5,638,545 A 6/1997 Rosner
5,683,134 A 11/1997 Espinosa
5,745,925 A 5/1998 Ghilardi et al.
5,778,888 A 7/1998 Sheehy
5,789,648 A * 8/1998 Roy et al. ..... 250/506.1

(Continued)

FOREIGN PATENT DOCUMENTS

EP 0 792 924 A1 9/1997

(Continued)

OTHER PUBLICATIONS

Mazel Technical Excellence—Radishield: Radiation Protection System, 8 pages.

(Continued)

*Primary Examiner*—Kiet T. Nguyen
(74) *Attorney, Agent, or Firm*—Hunton & Williams LLP

(57) ABSTRACT

An elastic, radiation shielding material that can be severed readily with conventional tools, such as scissors and is sufficiently flexible so as to allow wrapping it around piping and tubing. The radiation shielding material comprises a rubber component and a radiation attenuating metal in amounts effective to obtain a desired balance of flexibility and radiation attenuation, respectively. By varying the amount of rubber and metal in the material a desired level of flexibility and radiation attenuation may be obtained.

66 Claims, 6 Drawing Sheets

U.S. PATENT DOCUMENTS

| | | | | |
|---|---|---|---|---|
| 5,883,394 | A | 3/1999 | Mussman | |
| 5,908,884 | A | 6/1999 | Kawamura et al. | |
| 6,030,549 | A | 2/2000 | Kalb et al. | |
| 6,048,379 | A | 4/2000 | Bray et al. | |
| 6,136,429 | A * | 10/2000 | Saito | 428/323 |
| 6,310,355 | B1 | 10/2001 | Cadwalader | |
| 6,674,087 | B2 * | 1/2004 | Cadwalader et al. | 250/515.1 |

FOREIGN PATENT DOCUMENTS

| | | |
|---|---|---|
| WO | WO93/02457 | 2/1993 |

OTHER PUBLICATIONS

Declaration in Support of Information Disclosure Statement by Jerry G. Grimes, Sep. 2004.

Declaration in Support of Information Disclosure Statement by David M. Smith, Sep. 2004.

Thermo Electron Corporation, "Shielding Solutions for the 21st Century", Catalog 26.

Dow Corning, "Silastic® 3481 Base and Silastic® 81 Curing Agents".

Viton, "Specify Viton® fluoroelastomers for Superior Sealing Performance in a Wide Variety of Aggressive Application".

SafeRad, "GammaBlok®", retrieved from the internet on Aug. 29, 2006, retrieved from the internet at http://www.saferad.com/downloads.htm.

Zada Technologies, "Radiation Shielding", retrieved from the internet on Aug. 29, 2006, retrieved from the internet at http://www.zadatech.net.

Malcolm Wass, "Safer Radiography—A New Process", retrieved from the internet on Aug. 29, 2006, retrieved from the internet at http://www.ndt.net/article/wcndt00/papers/idn678/idn678.htm.

* cited by examiner

RADIATION SHIELDING

CROSS-REFERENCE TO RELATED APPLICATIONS

This is a continuation-in-part of application Ser. No. 09/803,035, filed Mar. 12, 2001 now abandoned, the entire contents of which are incorporated herein by reference.

FIELD OF THE INVENTION

The present invention generally relates to a radiation shielding (or radiation shielding material). More particularly it relates to a light, elastic, radiation shielding material that comprises a rubber and a metal, such as tungsten, bismuth or a combination thereof in an amount sufficient to block a desired percentage of radiation emitted from a radiation source. The present invention further relates to a method for making the radiation shielding material and to a method for using it in attenuating radiation from a radiation source.

BACKGROUND OF THE INVENTION

Lead wool or solid lead sheets (or blankets) are used in nuclear facilities, such as power plants or navy nuclear ships, as radiation shielding materials. Lead blankets are typically formed from a woven lead core, covered by and sometimes secured to an outer cover, such as a plastic material. The periphery of the outer cover typically is sewn together and metal grommets generally are mounted in the periphery.

The lead blankets are draped or hung over or against areas in the nuclear facilities which are to be shielded. The lead blankets are secured by cables or hooks which are inserted through the metal grommets to support the lead blankets in the desired location.

Once the lead blankets have been contaminated by radiation they must be disposed according to appropriate contamination guidelines. For example, the Resource Conservation and Recovery Act (RCRA) dictates guidelines for disposing of contaminated lead. Under RCRA, because the lead is a potentially hazardous material, a lead blanket contaminated by radiation becomes a "Mixed Hazardous Waste" which is more difficult to dispose than regular hazardous material. Lead itself used in a work environment may also require following potentially difficult or expensive guidelines. For example, the Occupational Safety and Health Administration has guidelines for preventing workers from coming into contact with lead and for requiring monitoring of lead exposure. Other problems exist with conventional lead blankets. For example, lead blankets are not sufficiently flexible to allow wrapping the blankets around small size piping and tubing.

SUMMARY OF THE INVENTION

The present invention overcomes the above and other disadvantages associated with conventional solid lead or lead wool blankets. The invention provides a light, flexible (or elastic) radiation shielding material (also referred to herein as "radiation shielding") that provides effective radiation attenuation. The radiation shielding material can be cut readily with conventional tools, such as scissors or a knife, and is sufficiently flexible as to allow wrapping it around piping and tubing. The radiation shielding material comprises a rubber component (or "rubber") and a metal in amounts effective to obtain a desired balance of flexibility and radiation attenuation, respectively. By varying the amount of rubber and metal in the material, a desired level of flexibility and radiation attenuation may be obtained. The rubber may be natural rubber or a synthetic rubber such as thermosetting or thermoplastic elastomers.

One feature of the radiation shielding material is that it does not contain hazardous waste materials, as defined by the Resource Conservation and Recovery Act (RCRA), and therefore cannot become a mixed hazardous waste if it is contaminated with radiation.

Another feature of the radiation shielding material is that it is inherently water repellent. Thus, in the event that it becomes radiologically contaminated, it may be disposed of as a standard radioactive waste. In another embodiment, as the radiation shielding material is water repellant, the material may be decontaminated and released from any regulatory radiological controls.

Another feature of the radiation shielding material is that it is elastic and sufficiently flexible so that it can be readily wrapped around piping and tubing.

Another feature of the radiation shielding material is that it is pliable and that it can be processed into a desired form such as a sheet, piping or tubing shape (so that it can be used to wrap pipes or tubes, which may carry radioactive fluid) using conventional processing techniques for rubber materials, such as injection molding, calendering, extrusion, etc.

Yet another feature of the radiation shielding material is that it provides sufficient radiation attenuation, at least comparable if not better to less flexible lead wool blankets.

One aspect of the present invention relates to a radiation shielding material comprising a rubber component (or rubber) and a metal in amounts effective to obtain a desired balance of flexibility and radiation attenuation. The metal is selected to provide effective radiation attenuation to the radiation shielding material, while the rubber is selected to provide sufficient flexibility to the radiation shielding. By varying the amount of rubber and metal in the material a desired level of flexibility and radiation attenuation may be obtained. Also, the rubber and metal may be selected to meet specific temperature requirements of a particular application. For example, a higher melting point metal may be selected for an application requiring higher heat resistance. The metal may be in pure elemental form or an alloy. The radiation shielding material may include additives, such as reinforcing fillers and processing aids.

Another aspect of the present invention relates to a method for making the radiation shielding material. The method comprises mixing effective amounts of a rubber, a metal, and a curing agent to form a substantially homogeneous or uniform mixture. The mixture is then processed into a desired form and cured to form a dense, elastic material that can be easily cut using conventional cutting tools, such as scissors.

In another aspect, the present invention relates to a method for making the radiation shielding material comprising mixing effective amounts of a rubber and a metal, without a curing agent, to form a substantially homogeneous or uniform mixture. The radiation shielding material possesses a low durometer or hardness value (e.g., a "putty-like" hardness). The material may be formed into any shape. For example, the radiation shielding material may be shaped around a radioactive source in the same way that modeler's clay might be shaped around an artist's cast.

Yet another aspect of the present invention relates to a method for partially blocking or attenuating radiation from a radiation source or area. The method comprises covering the radiation source or area with a sheet of the radiation shielding material having an effective thickness sufficient for blocking a desired percentage of the radiation emitted from the radiation source.

These and other features and advantages of the present invention will become apparent to a person skilled in this art from the description of preferred embodiments in conjunction with the following figures.

DETAILED DESCRIPTION OF THE PREFERRED EMBODIMENTS

Figure 1:
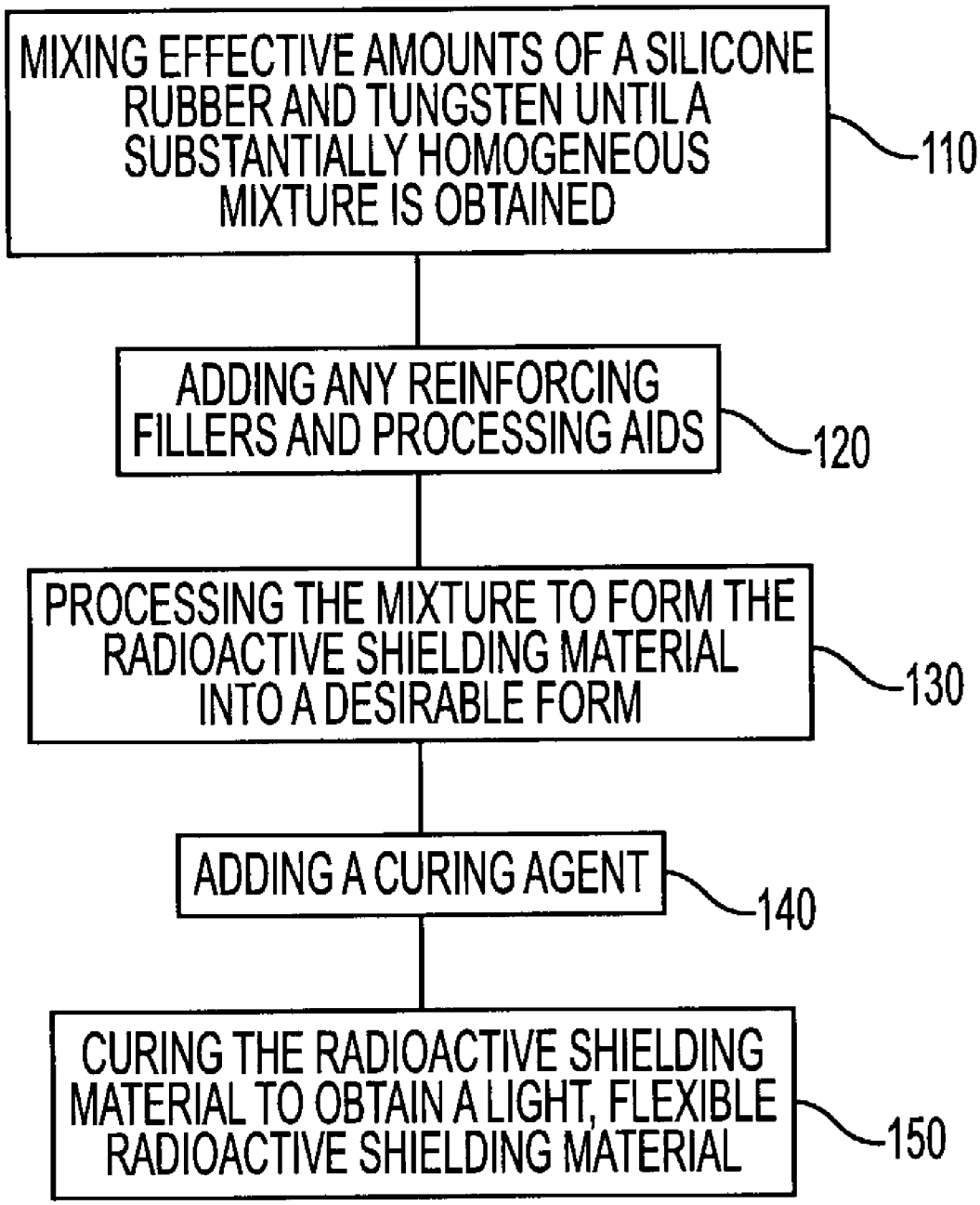
FIG. 1 is a flow chart of one embodiment of a method for making the radiation shielding material of the present invention.

The term "about" or "approximately" means that the numerical value modified by that term may vary by 20% to 5%. For the purposes of this application, the term "micrometer" means "micron", and vice versa. The term "diameter" means any line passing through the center of a figure or body (e.g., circle, conic section, sphere, cube, elongated object, or the like) and terminated by the opposite boundaries. The term "average particle size" means the length of the longest dimension of a particle of the metal used in present invention. The term "average particle size" includes diameter. For example, the average particle size means the length of the longest dimension of a particle having rectangular cross-section or any parallelogram cross-section.

The present invention relates to a light, elastic, radiation shielding material that can be readily cut into the desired size and wrapped around piping, tubing or other areas of nuclear plants or nuclear ships that require radiation shielding. The radiation shielding of the invention may also be referred to herein as "STEF". In its broadest aspects the material comprises a rubber component and radiation attenuation metal (or a "metal") in amounts effective to obtain a desired balance of flexibility and radiation attenuation, respectively. The amount of rubber may range from about 5 percent by weight to about 35 percent by weight, more preferably from about 10 percent by weight to about 30 percent, and most preferably from about 10 percent by weight to about 20 percent by weight based on the total weight of the radiation shielding material. The amount of metal may range from about 65 percent by weight to about 95 percent by weight, more preferably from about 70 percent by weight to about 90 percent by weight and most preferably from about 80 percent by weight to about 90 percent by weight.

In another embodiment the amount of rubber may range from 5 percent by weight to 35 percent by weight, more preferably from 10 percent by weight to 30 percent by weight, and most preferably from 10 to 20 percent by weight, based on the total weight of radiation shielding material. In this embodiment, the amount of metal may range from 65 percent by weight to 95 percent by weight, more preferably from 70 to 90 percent by weight, and most preferably from 80 percent by weight to 90 percent by weight, based on the total weight of radiation shielding material. The metal is selected to provide effective radiation attenuation characteristics to the radiation shielding material, while the rubber is selected to provide sufficient flexibility to the radiation shielding. By varying the amount of rubber and metal in the material, a desired level of flexibility and radiation attenuation may be obtained. Preferably, the rubber, the metal and the radiation shielding material should also be sufficiently heat resistant to withstand temperatures ranging from about 220° F. (104° C.) to about 400° F. (204° C.). Also preferably, the rubber and the metal should be non-hazardous materials. Reinforcing fillers may be used to improve the strength of the radiation shielding material. Also, processing aids may be used to improve the processing of the rubber.

Suitable rubber compounds include natural rubbers, such as polyisoprene, and synthetic rubber (the latter also known as elastomers). Suitable synthetic rubbers or elastomers may include synthetic thermosetting high polymers having properties similar to those of vulcanized natural rubber (thermosetting rubbers) such as styrene-butadiene copolymer, polychloroprene (neoprene), acrylonitrilbutadiene copolymers (nitrile rubber), butyl rubber, butadiene-styrene copolymers (SBR), polysulfide rubber, cis-1,4, polyisoprene, ethyleneepropylene diene terpolymers (EPDM rubber), silicone rubber, and polyurethane rubber. These can be cross-linked with sulfur, peroxides, or similar agents. Suitable elastomers may also include uncross-linked polyolefins that are thermoplastic, generally known as TPO rubbers. Preferred elastomers include butadiene-styrene copolymers (SBR), acrylonitrilbutadiene copolymers (nitrile rubber), ethylenepropylene-diene terpolymers (EPDM rubber), and silicone rubbers (also known as silicone or polysiloxane). More preferred are silicone rubbers having methyl, vinyl, phenyl and/or trifluoropropyl side (or pendant) groups along the Si—O polymer chain. Most preferred are dimethyl silicone rubber, phenyl methyl silicone rubber, phenyl silicone rubber, polyvinyl silicone rubber (or polyvinyl siloxane) and fluorosilicone rubber. One useful silicone rubber is polydimethylsilicone based elastomer. More than one chemical side group can also be included in the same polymer to combine the advantages of each side group. For example, phenyl vinyl silicone rubber, i.e., a silicone rubber containing both vinyl and phenyl side groups may be used for improved crosslink efficiency and extended low temperature flexibility. Without wishing to be bound by any operability theory, it is believed that one function of the rubber component is to act as a bonding agent, i.e., to bond the metal particles to form an elastic composite material.

Suitable metals are the ones that can be combined with a rubber to form a dense, elastic and sufficiently flexible radiation shielding material that exhibits a desired level of radiation attenuation. The desired level of attenuation may range depending on the application. Generally, however, the radiation attenuation of the radiation shielding material of the present invention should be comparable, if not better, to the radiation attenuation obtained with conventional lead wool or solid lead blankets. For example, in one embodiment the radiation shielding material may be formulated to provide radiation attenuation comparable to the radiation attenuation obtained with a lead wool blanket having a thickness of about 0.50 inches (or 0.50 inches) shielding the energy from a radioactive cobalt 60 material. A 2.0 inch sheet of solid lead typically blocks 90 percent of the radiation emitted from a cobalt 60 radioactive material. In a preferred embodiment, the radiation shielding material is formulated to provide radiation attenuation at all energy levels. In another preferred embodiment, the radiation shielding material is formulated to provide radiation attenuation at an energy level of approximately 1,173 kV to approximately 1,332 kV. In a further preferred embodiment, the radiation shielding material is formulated to provide radiation attenuation from a cobalt 60 radioactive material. In another preferred embodiment, the radiation shielding material is formulated to provide radiation attenuation at an energy level of approximately 1,173 kV to approximately 1,332 kV from a cobalt 60 radioactive material. Examples of suitable radiation attenuating metals include tungsten, bismuth, corrosion resistant steels, such as stainless steel, and combinations thereof. The radiation attenuating metal may be an element or an alloy, preferably in powder or granular form having an average particle size ranging from about 0.4 to about 45 micrometers, more preferably from about 2 to about 15 micrometers, and most preferably from about 3 to about 3.5 micrometers, such as 3 to 3.5 micrometers. In another embodiment, the metal (also preferably in powder or granular form) may have an average particle size ranging from about 0.4 to about 45 micrometers, more preferably from about 2 to about 15 micrometers, and most preferably from about 3 to about 3.5 micrometers. Such metals are commercially available. Preferably, the metal is in a rounded form. More preferably the metal is in a spherical shape. However, the metal may be in any shape or form, including but not limited to, spheres, rounded objects, elongated shapes, having cross-sectional shapes of squares, rectangles, triangles, or any other shape or form. Tungsten is more preferred for applications requiring generally higher temperatures, however, bismuth is more preferred for lower temperature applications because it exhibits similar radiation attenuation characteristics to tungsten but is less expensive than tungsten. In a preferred embodiment, the particles are of regular, uniform size. In another preferred embodiment, at least 60% of the particles have an average particle size of less than 100 micrometers. In a further preferred embodiment, at least 75% of the particles have an average particle size of less than 100 micrometers. In a further preferred embodiment, at least about 99% of the particles have an average particle size of less than 100 micrometers. In yet another preferred embodiment, at least 60% of the particles have diameters of less than 100 micrometers.

In a further preferred embodiment, at least 75% of the particles have diameters of less than 100 micrometers. In a further preferred embodiment, at least about 99% of the particles have diameters of less than 100 micrometers. In a further preferred embodiment, the particles are combined with a rubber to form a particulate composite homogeneous mixture.

In a preferred embodiment of the present invention, the radiation shielding material does not contain detrimental materials in high enough concentration to cause damage to stainless steel. In a further preferred embodiment, the radiation shielding material contains materials in accordance with the requirements set forth in U.S. Military Standards. In a further preferred embodiment, the radiation shielding material is in compliance with U.S. Military Standard MIL-STD-2041.

The radiation shielding material may be processed into a desired form such as sheet, piping or tubing using conventional processing methods used for rubber materials. The rubber component of the radiation shielding material may be cured to form an elastic, radiation shielding material either concurrently with the step of processing it into a desired form or after forming the material into the desired form, using conventional curing methods. Other additives such as reinforcing fillers and processing aids may also be added to the material.

A preferred method for making the radiation shielding material comprises compounding or mixing the various components of the material in an internal mixer, such as a Banbury mixer, at the desired proportions. Prior to mixing, the rubber material may be subjected to a freshening step, i.e., mechanically plasticizing or softening the rubber to render the rubber more pliable prior to adding the radiation attenuation metal and the other compounds (or components). This is because often times, many rubber materials such as silicone rubbers, even with the addition of process aids, show some degree of structure (i.e., stiffness) with time, and benefit from freshening prior to fabrication. Upon sufficient mixing in the Banbury mixer of the various components, a substantially homogeneous or uniform mixture is obtained. The mixture is then processed into a desired form (or "shape") and cured to form a dense, elastic material using conventional processes for rubber materials, such as extrusion, injection molding, calendering, compression molding or transfer molding.

Typically, curing requires the addition of a curing agent which may be added either concurrently with or after processing the material into a desired shape.

One preferred embodiment of the present invention relates to a radiation shielding material comprising silicone rubber and tungsten. Preferably, the amount of silicone rubber in the material may range from about 5 percent by weight to about 35 percent by weight, more preferably from about 10 percent by weight to about 30 percent by weight and most preferably from about 10 percent by weight to about 20 percent by weight based on the total weight of the radiation shielding material. Examples of commercial silicone rubber materials that may be used include ZALAK®, KALREZ® AND VITON® available from DuPont de Nemerus & Company, and RTV9950 and RTV9811 supplied by General Electric. Also, preferably, the amount of tungsten in the radiation shielding material (or "material") may range from about 65 percent by weight to about 95 percent by weight, more preferably from about 70 percent by weight to about 90 percent by weight, and most preferably from about 80 to about 90 percent by weight based on the total weight of the material. In another preferred embodiment, the amount of tungsten in the material may range from about 10 percent by volume to about 60 percent by volume and the amount of rubber in the material may range from about 90 percent by volume to about 40 percent by volume. In a more preferred embodiment, the amount of tungsten in the material may range from about 20 percent by volume to about 40 percent by volume and the amount of rubber in the material may range from about 80 percent by volume to about 60 percent by volume. In a further preferred embodiment, the amount of tungsten in the material may range from about 25 percent by volume to about 35 percent by volume and the amount of rubber in the material may range from about 75 percent by volume to about 65 percent by volume. In one particular embodiment, the amount of tungsten in the material is about 32% by volume, or, alternatively, 32% by volume and the amount of rubber in the material is about 68% by volume, or, alternatively, 68% by volume.

Preferably, in any embodiment, tungsten may be used in pure elemental powder form having an average particle size ranging from about 0.4 to about 15 micrometers, more preferably from about 2 to about 15 micrometers, and most preferably from about 3 to about 3.5 micrometers.

In another embodiment, the material may comprise 5 percent by weight to 35 percent by weight, more preferably 10 percent by weight to 30 percent by weight, and most preferably 10 percent by weight to 20 percent by weight of the silicone rubber, based on the total weight of the radiation shielding material. In this embodiment, the material may comprise 65 to 95 percent by weight, more preferably 70 to 90 percent by weight, and most preferably 80 to 90 percent by weight of tungsten, based on the total weight of the material.

In any embodiment, tungsten may be used in pure elemental powder form having an average particle size of 0.4 to 15 micrometers, preferably 2 to 15 micrometers, and more preferably from about 3 to about 3.5 micrometers.

Other metals can be used in total or partial replacement of the tungsten, such as bismuth and stainless steels. More preferred are combinations of silicone rubber with tungsten, silicone rubber with bismuth, or silicone rubber with tungsten and bismuth. In one embodiment a blend of tungsten and bismuth is used, having approximately equal proportions of the two metals, instead of tungsten.

In one preferred embodiment, the radiation shielding material comprises about 90 percent by weight tungsten and about 10 percent by weight of silicone rubber, preferably 90 percent by weight tungsten and 10 percent by weight silicone rubber. In another preferred embodiment the radiation shielding material comprises about 83 percent by weight tungsten and about 17 percent by weight of silicone rubber, preferably 83 percent by weight tungsten and 17 percent by weight silicone rubber. In yet another embodiment the radiation shielding material comprises about 80 percent by weight tungsten and about 20 percent by weight of silicone rubber, preferably 80 percent by weight tungsten and 20 percent by weight silicone rubber. In yet another embodiment the radiation shielding material comprises about 75 percent by weight tungsten and about 25 percent by weight of silicone rubber, preferably 75 percent by weight tungsten and 25 percent by weight silicone rubber.

The radiation shielding material of the present invention may be formulated to withstand long-term usage and potential abuse. For example, the material may be formulated to withstand covering sharp-edged piping, workers walking on the material, or similar applications. In a preferred embodiment, the radiation shielding material of the present invention has a minimum durometer of 60*10 (ASTM D2240, shore A). In another preferred embodiment, the material has a tensile strength of about 200 to about 800 lbs/in$^2$ (ASTM D412). In a further preferred embodiment, the material has a tensile strength of about 400 to about 600 lbs/in$^2$ (ASTM D412). In another preferred embodiment, the material of the present invention has a tear strength of 40 to 140 lbs/in (ASTM D624, die B). In a further preferred embodiment, the material has a tear strength of 75 to 105 lbs/in (ASTM D624, die B).

Referring now to FIG. 1, an embodiment for making the radiation shielding material is schematically illustrated. The method comprises mixing silicone rubber with tungsten powder ("raw materials") using, for example, a Banbury mixer until a homogeneous mixture is obtained, according to step 110. The sequence of adding the raw materials in the mixer may vary, preferably, however, silicone rubber may be added first followed by the addition of the tungsten powder. The metal powder is preferably added gradually to achieve a satisfactory, homogeneous mixture. In addition, to the silicone rubber and the tungsten, other conventional materials may be added, such as reinforcing fillers and processing aids, according to step 120.

After sufficient mixing to obtain a substantially homogenous mixture, the mixture is processed to form the radiation shielding material into a desirable form, according to step 130. The mixture is processed into a desirable form by any conventional technique or method, e.g., extrusion. For example, the material may be made as a continuous sheet having sufficient thickness to effectively attenuate radiation from the shielded area. The thickness may typically range from about 0.1 to about 1 inch, preferably 0.1 to 1.0 inch, more preferably from about 0.125 inches to about 0.4 inches, or 0.125 to 0.4 inches. In one embodiment the radiation shielding material has the thickness of 0.50 inches. Many different well known processes can be used to make the material, as discussed above. Exemplary, Banbury mixing processes and methods for processing rubbers into desired shapes are described in U.S. Pat. Nos. 4,150,010; 4,164,491; 4,197,381; 4,201,698; 4,202,812; 4,234,702; 5,623,028; 5,908,897; 6,177,506; 6,162,854; and 6,001,917 which are incorporated herein by reference for all purposes and to the extent that they are not inconsistent with the disclosure and claims of the present invention.

A curing agent is also added to the mixture, according to step 140. The curing agent is added in an effective amount to achieve sufficient curing of the silicone rubber in the mixture, preferably upon the application of heat. Examples of curing agents that may be used for curing silicone rubber may include dibutyl tin dilaureate (DBT), and stannous tin octoate (STO). The method also includes curing the radiation shielding material, according to step 150. Alternatively, the curing agent may be added to the mixture during the processing step to effect curing of the mixture concurrently with the formation of the desired shape, typically with application of heat. A catalyst may also be added during the curing step to facilitate curing according to conventional processes. The curing conditions may vary depending upon the curing agent, the catalyst and the specific composition of the rubber material used. The curing step may comprise heating the radiation shielding material containing a curing agent to an effective temperature and for a sufficient time as to sufficiently cure the rubber in the radiation shielding material. For example, curing may be effected by directing the radiation shielding material exiting the processing step 130 to the vicinity of conventional heating means, such as an oven, and heating the material till sufficient curing of the rubber is obtained. According to one embodiment the radiation shielding material is obtained in the form of a continuous sheet exiting the die of an extruder and cured by exposing it to heat generated by conventional heating means, such as a curing oven.

Typically, the curing temperature for a silicone rubber compound may range from about 212° F. (100° C.) to about 392° F. (200° C.), more preferably from about 230° F. (110° C.) to about 356° F. (180° C.).

Other methods of curing may also be employed, such as addition cure. For example, a methylvinyl silicone rubber may be cured with the addition of a silicone hydride (SiH) crosslinking agent and a precious metal catalyst such as platinum. This reaction may occur at room temperature, thus inhibitors are typically added to the rubber to prevent premature curing. Other additives may be used to enhance specific properties of the radiation shielding material such as heat resistance.

Curing agents may vary depending on the type of a rubber compound used. Suitable curing agents for silicone rubber compounds include organic peroxides. Cure time and temperature may vary. Typically cure time is a function of the activation temperature of the particular peroxide and the thickness of the radiation shielding material. Various particular curing agents may be used. Dialkyl peroxides, such as dicumyl peroxides, are generally suitable with vinyl containing silicone rubbers. Diacyl peroxides, such as benzoyl peroxide, are preferred with silicone rubbers containing both vinyl and methyl side groups. The peroxides may be used as liquids, powders, or as pastes made from silicone fluids and gums.

Alternatively, the silicone rubber may be combined with tungsten and/or bismuth, heat and corrosion resistant metals or processing aids without a curing agent, to form a material that will remain pliable for a long period of time. This material may be used to make a form fit of the items to be shielded, similarly to the use of a modeling clay.

In any embodiments described herein where tungsten is used as the radiation attenuating metal, any other suitable metal (or a combination of metals described herein) may be used instead of or in addition to the tungsten, such as bismuth, corrosion resistant steels or combination(s) thereof. In such embodiments, relative proportions of the metal (or metals) are such which produce the radiation shielding material of this invention, having the properties defined herein. In one embodiment, the content of metal (or metals) may be from about 65 to about 95 percent by weight or from 65 to 95 percent by weight, preferably from about 70 to about 90 percent by weight or from 70 to 90 percent by weight, based on the total weight of the radiation shielding material.

In yet another variation of the present invention, the radiation shielding material may be processed to incorporate a variety of fibers or fabric-type materials (collectively "fabric material") made from cotton fibers, synthetic fibers, fiberglass fibers, aramid fibers, Kevlar fibers etc., to strengthen the radiation shielding material. The fabric material may be added as a separate layer 2 securely attached to at least one side of the radiation shielding material 1 or to both sides thereof. Alternatively, fibers may be added to the mixture during the mixing step 110, before or during the processing step 130. In another embodiment, the radiation shielding material is made only of the mixture of rubber and metal and does not have separate layers on the outside thereof made from other materials.

In all embodiments of making the radiation shielding material, the proper amounts of the metal, the rubber, the curing agent and the various other components are measured and added employing conventional equipment as to obtain the radiation shielding material having the properties defined herein, which may include the relative amounts of the metal and rubber discussed herein.

The present invention radiation shielding material may also be used in applications wherein metal activation may be a concern. This is because tungsten and bismuth do not become readily activated. It is also possible to include other metals, but for applications wherein activation is a concern only metals that do not become readily activated may be used such as, for example aluminum.

Preferably, the radiation shielding material should be sufficiently flexible as to permit wrapping it around piping and tubing systems. In a preferred embodiment, the radiation shielding material is sufficiently flexible to wrap around piping and tubing systems having a diameter ranging from about 0.1 inches to about 24 inches. The shielding material may be wrapped around the piping and secured in place using conventional means such as Velcro® and plastic tie wraps. The radiation shielding material may also be used to shield walls or flooring. The radiation shielding material of the present invention is generally light and preferably is as light or lighter than existing lead containing shielding materials that provide comparable radiation attenuation. The radiation shielding material may be formed in many different shapes and sizes. For example, it may be formed in the shape of a sheet having a thickness of from about 0.125 inches to about 1.0 inch, 0.125 to 1.0 inch, about 0.125 inches to about 0.75 inches, 0.125 inches to 0.75 inches, about 0.125 inches to about 0.5 inches or 0.125 inches to 0.5 inches. In some embodiments, the radiation shielding material has a thickness of 0.25 or 0.5 inches.

Suitable reinforcing fillers that can be used with a silicone rubber include fumed silica, precipitated silicas, iron oxide, titania, aluminum trihydrate and carbon black. More preferred is fumed silica.

Process aids, such as softeners, may be employed with the silicone rubber of the present invention and are typically reactive silicone fluids which chemically modify the surface of the silica fillers (e.g., fumed silica and precipitated silicas) to reduce their association with the silicone rubber. The process aids may be prereacted with the silica filler(s) in a pretreatment process, or may be introduced during the mixing step 110 to effect "in-situ" treatment. Alternatively, both techniques of introducing the process aids may be used. The addition of process aids prevents hardening of the uncured silicone rubber during the mixing step 110 and processing step 130. Without a process aid the uncured silicone rubber crumbles and cracks instead of forming a smooth, continuous, pliable material. In addition to processability improvements, process aids may also improve the dispersion of the fillers and the physical properties of the silicone rubber, and thus the properties of the radiation shielding material.

By controlling the purity of the components, the radiation shielding material can readily meet specific purity requirements that may vary depending upon the ultimate application. For example, for applications requiring high temperature resistance, the radiation shielding material may include not more than 250 ppm of low melting point metals such as antimony, bismuth, cadmium, lead, tin, and zinc. Also, other applications may require that the radiation shielding material may not have more than 10 ppm of mercury, or more than 250 ppm of any of the following compounds or elements, bromides, chlorides, fluorides, sulfur, and phosphorus.

In one embodiment, the radiation shielding material is formed into a molded collar including an integral closure strap, e.g., made of Velcro®. The molded collars are split to allow it to be spread open to go on piping. Once in place the Velcro® strap is used to secure the material and eliminate the gap in the material.

A method for attenuating or blocking radiation from a radiation source is provided comprising providing a radiation shielding material having an effective thickness sufficient for blocking a desired percentage of the radiation emitted from the radiation source. The method further comprises using the radiation shielding material to diminish or block radiation from the radiation source.

The radiation shielding material may be used in a variety of ways, e.g., by hanging a blanket of the radiation shielding material around the radiation source, covering the radiation source with the radiation shielding material, creating a curtain around the radiation source, wrapping the radiation shielding material around the radiation source, or using it in layered blankets. The radiation shielding material can be used with or without bagging used in the industry, such as Nylon/Herculite® bagging. Since the radiation shielding material is elastic, and flexible it can be wrapped around relatively small objects, such as pipes having a diameter of between about 0.5 and about 24 inches or between 0.5 and 24 inches.

Figure 2:
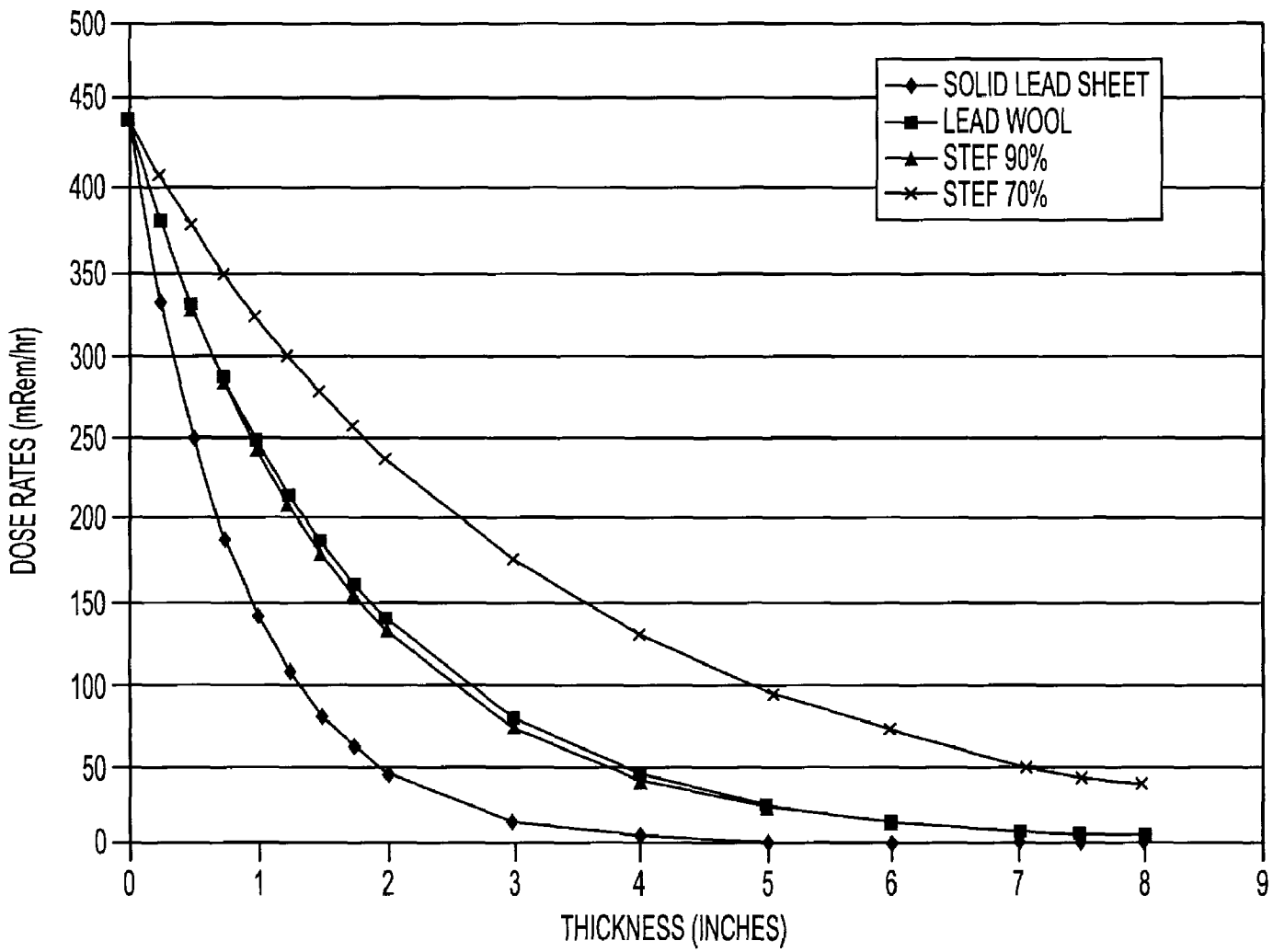
FIG. 2 shows the radiation attenuation obtained with two embodiments of the radiation shielding material of the present invention as compared to the radiation attenuation obtained with a lead wool sheet and that obtained with a solid lead sheet.

FIG. 2 shows the radiation attenuation curves for four materials at various thickness: 1) a radiation shielding material containing 90 percent by weight tungsten and 10 percent by weight silicone (STEF 90%), 2) a radiation shielding material containing 70 percent by weight tungsten and 30 percent by weight silicone (STEF 70%), 3) a solid lead sheet (lead), and 4) a lead wool sheet (lead wool). The radiation source was a cobalt-60 with a source strength of 23.5 millicuries.

Figure 3:
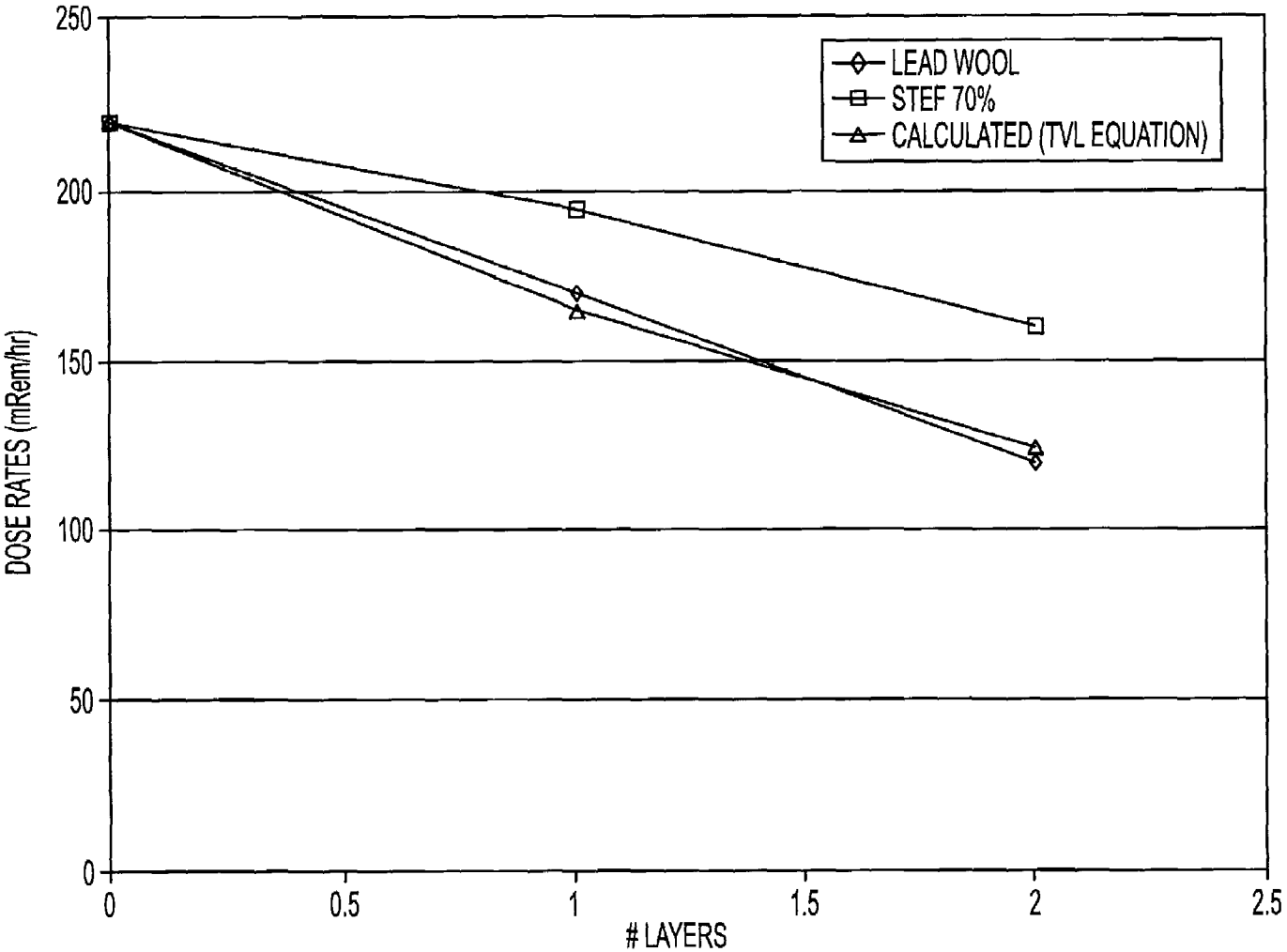
FIG. 3 shows the radiation attenuation obtained with an embodiment of the invention radiation shielding material as compared to the radiation attenuation obtained with a lead wool sheet.

FIG. 3 shows the radiation attenuation obtained with an embodiment of the invention radiation shielding material containing 70% tungsten and 30 percent silicone (STEF 70%) as compared to the radiation attenuation obtained with a lead wool sheet. The radiation source was a cobalt-60 source with a source strength of 5.38 millicuries. Measurements were taken with one layer and with two layers of the shielding material. Each layer had a thickness of 0.5 inches. TVL is the amount or thickness of a lead or other shielding material required to obtain a 0.1 value level in the radiation passing through the shielding material.

Figure 4:
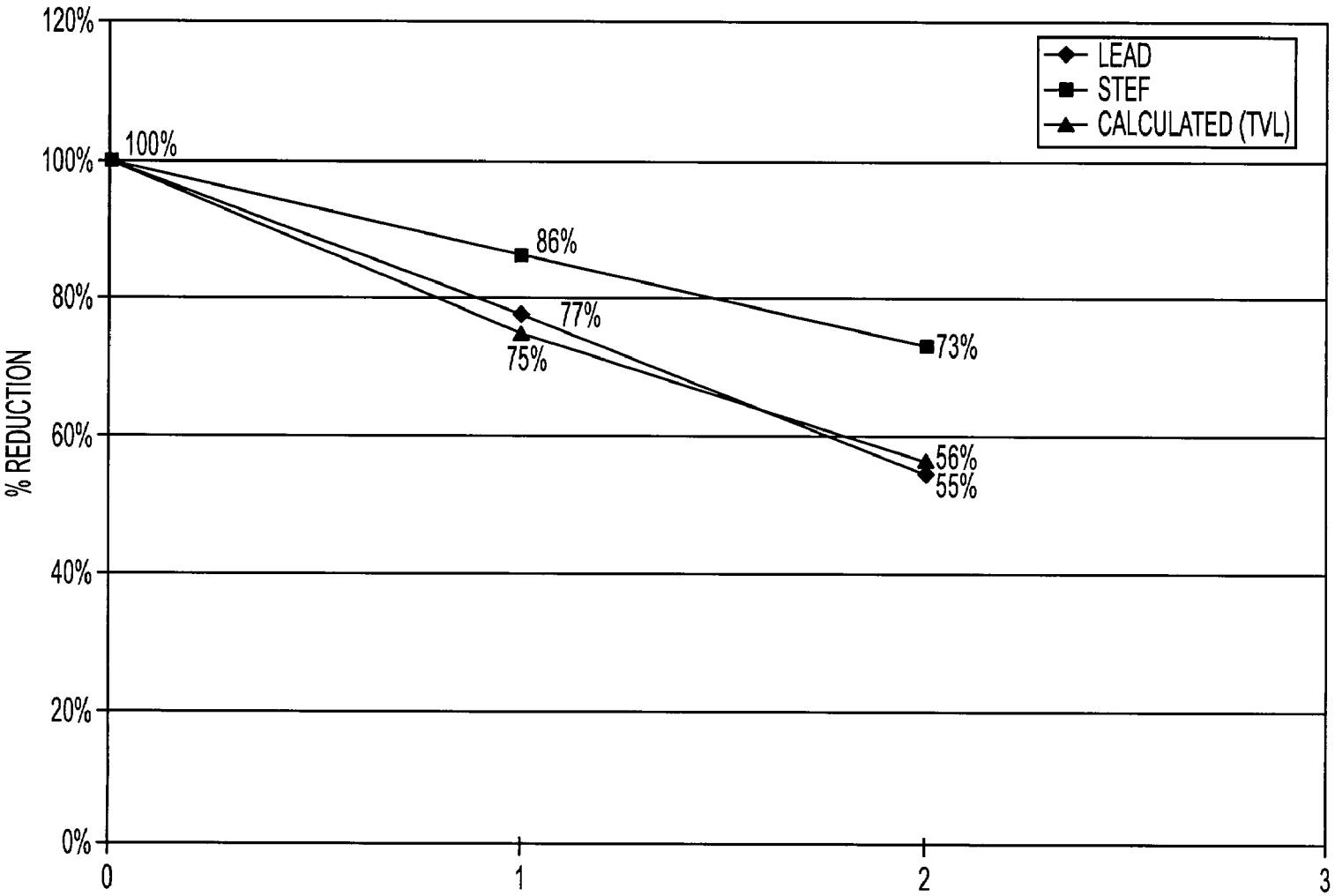
FIG. 4 shows the percent reduction in the radiation level obtained per each layer of a shielding material used, according to an embodiment of the invention.

FIG. 4 shows the percent reduction per layer in the radiation level for the shielding materials and test conditions used in FIG. 3.

Figure 5:
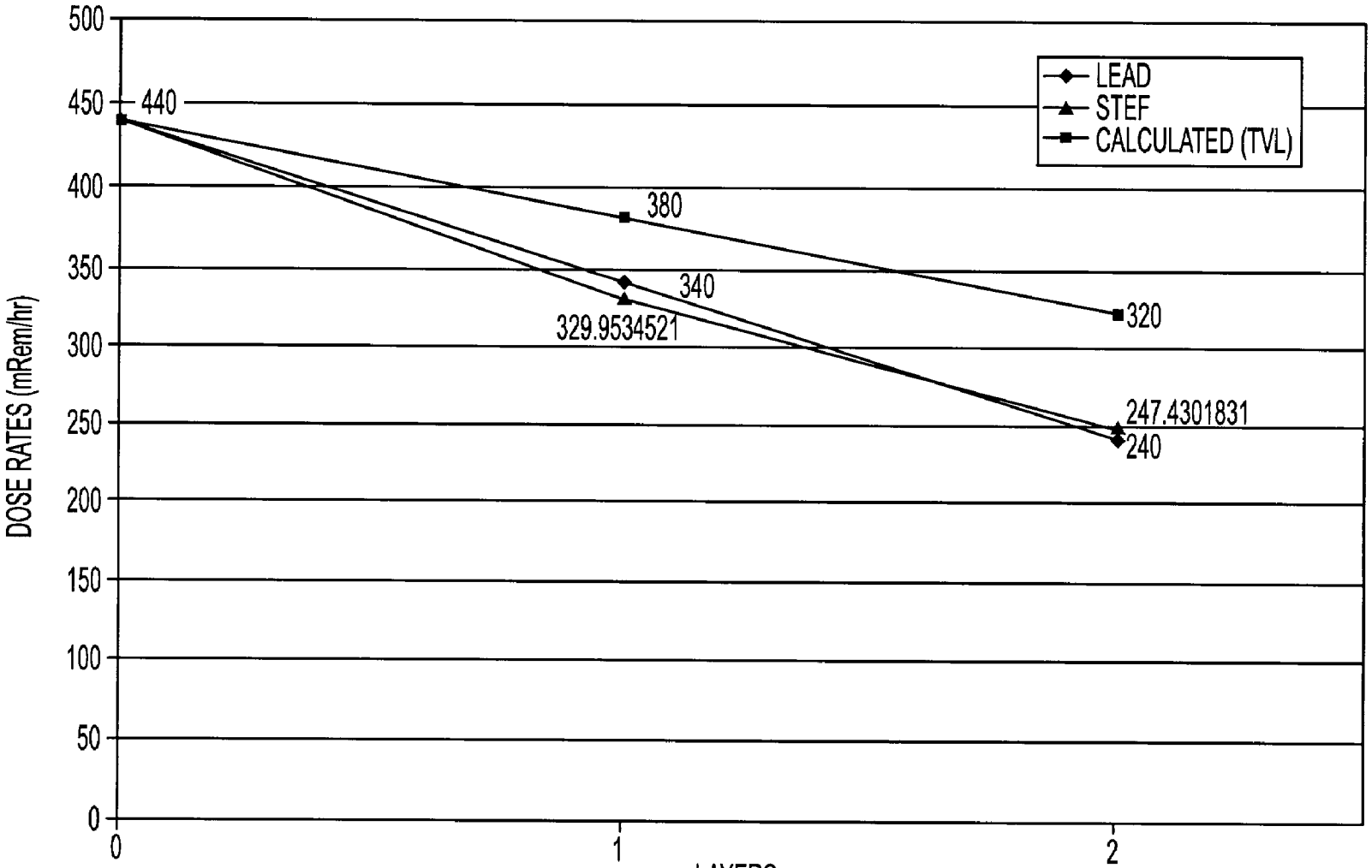
FIG. 5 shows the radiation attenuation obtained with an embodiment of the radiation shielding material of the present invention as compared to the radiation attenuation obtained with a lead wool sheet.
Figure 6:
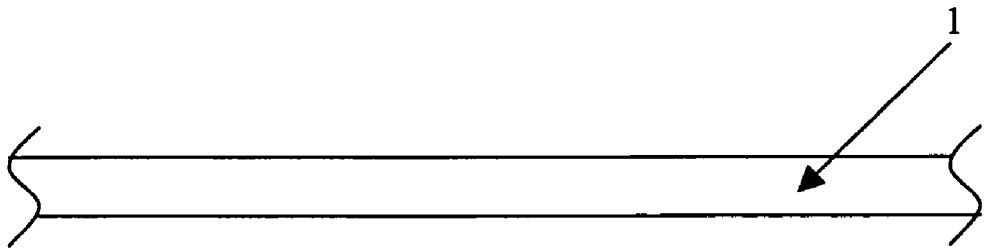
FIG. 6 shows a schematic illustration of an embodiment of then invention in the form of a sheet.
Figure 7:
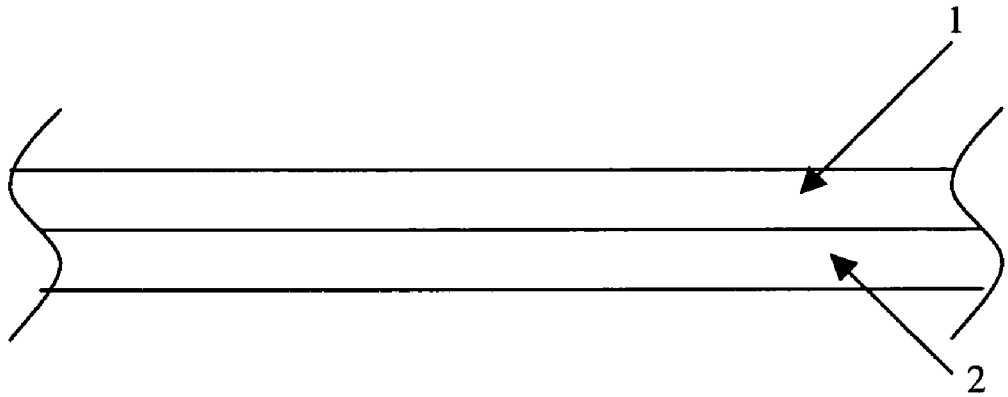
FIG. 7 shows a schematic illustration of an embodiment of then invention in the form of a sheet having fabric material attached to one side of the radiation shielding material.

FIG. 5 shows the radiation attenuation obtained with a radiation shielding material containing 70 percent tungsten and 30 percent silicone (STEF 70% as compared to that obtained with lead wool. The radiation source used was Cobalt-60 with a source strength of 23.5 millicuries. The material thickness of a layer was 0.5 inches.

Variations and modifications within the scope of the invention will become apparent when considered together with the following examples, which are set forth as being merely illustrative of the invention and which are not intended, in any manner, to be limiting.

EXAMPLES

Example 1

An elastic, radiation shielding material comprising about 90 percent by weight tungsten and about 10 percent by weight silicone rubber was prepared (STEF 90%) in the shape of a sheet having a thickness of about 0.50 inches. As FIG. 2 shows the radiation attenuation obtained with the 90% silicone-tungsten material was comparable to if not better than the radiation attenuation obtained with lead wool. For example, a STEF 90% material having a thickness of 0.5 inches caused a 26 percent reduction in the level of radiation, or 326 mRem from 440 mRem.

Moreover, the silicone-tungsten material was sufficiently flexible as to allow wrapping it around small size tubing, e.g., having a diameter of 0.25 inches. The lead wool was substantially less flexible and allowed wrapping a tube of not less than approximately 1 inch.

Example 2

An elastic, radiation shielding material comprising about 70 percent by weight tungsten and about 30 percent by weight silicone rubber was prepared (STEF 70%) in the shape of a sheet having a thickness of about 0.50 inches. FIG. 2 shows the radiation attenuation obtained with this material at various thicknesses. As FIG. 3 shows the radiation attenuation of radiation emitted by a cobalt-60 radioactive material obtained with a 1 inch thick STEF 70% material was comparable to if not better than the radiation attenuation obtained with a 0.50 inches thick lead wool.

Moreover, the silicone-tungsten material was sufficiently flexible as to allow wrapping it around small size tubing, e.g., having a diameter of 0.25 inches. The lead wool was substantially less flexible and allowed wrapping a tube of not less than approximately 1 inch.

Example 3

An elastic, radiation shielding material comprising about 90 percent by weight bismuth and about 10 percent by weight silicone rubber is prepared in the shape of a sheet having a thickness of about 0.50 inches. The radiation (silicone-bismuth) material exhibits radiation attenuation of radiation emitted by a cobalt-60 radioactive material that is comparable to that obtained with a 0.25 inches thick lead wool blanket. Moreover, the silicone-tungsten material is sufficiently flexible as to allow wrapping it around small size tubing, e.g., having diameter of 0.25 inches.

Example 4

An elastic, radiation shielding material comprising about 70 percent by weight bismuth and about 30 percent by weight silicone rubber is prepared in the shape of a sheet having a thickness of about 0.50 inches. The radiation shielding (silicone-bismuth) material exhibits radiation attenuation of radiation emitted by a cobalt-60 radioactive material that is comparable if not better to that obtained with a 0.25 inches thick lead wool blanket. Moreover, the silicone-tungsten material is sufficiently flexible as to allow wrapping it around small size tubing, e.g., having diameter of 0.25 inches.

The foregoing embodiments have been presented for the purpose of illustration and description only and are not to be construed as limiting the scope of the invention in any way. The scope of the invention is to be determined from the claims appended hereto.

What is claimed is:

1. A radiation shielding material comprising:

an effective amount of silicone rubber;

an effective amount of a metal having radiation attenuating characteristics; wherein said metal having radiation attenuating characteristics comprises particles, wherein at least 60% of said particles have diameters of less than 100 micrometers and wherein the average particle size is in the range of about 0.4 micrometers to about 45 micrometers; and wherein said radiation shielding material has a minimum Shore A durometer hardness of 50 according to ASTM D2240.

2. The radiation shielding material of claim 1, wherein at least 75% of said particles have diameters of less than 100 micrometers.

3. The radiation shielding material of claim 1, wherein at least about 99% of said particles have diameters of less than 100 micrometers.

4. The radiation shielding material of claim 1, wherein at least about 60% of said particles have diameters of between about 1 and about 5 micrometers.

5. The radiation shielding material of claim 1, wherein said metal having radiation attenuating characteristics is selected from the group consisting of tungsten, bismuth, and stainless steel.

6. The radiation shielding material of claim 1, wherein said silicone rubber includes one or more methyl, vinyl, phenyl, or trifluoropropyl side or pendant groups along the Si—O polymer chain.

7. The radiation shielding material of claim 1, wherein said silicone rubber comprises dimethyl silicone rubber, phenyl methyl silicone rubber, phenyl silicone rubber, polyvinylsilicone rubber, fluorosilicone rubber, or polydimethylsilicone based elastomer.

8. The radiation shielding material of claim 1, further comprising a reinforcing filler and processing aids.

9. The radiation shielding material of claim 1, wherein the metal having radiation attenuating characteristics is tungsten or bismuth.

10. The radiation shielding material of claim 1, wherein the metal having radiation attenuating characteristics is tungsten.

11. The radiation shielding material of claim 1, wherein the shielding material comprises from about 65 percent by weight to about 95 percent by weight of the metal having radiation attenuating characteristics, based on the total weight of the material, and from about 5 to about 35 percent by weight of the silicone rubber, based on the total weight of the material.

12. The radiation shielding material of claim 1, further comprising heat and corrosion resistant metals.

13. The radiation shielding material of claim 1, which comprises about 70 to about 90 percent by weight of the metal, based on the total weight of the material, and about 10 to about 30 percent by weight of the silicone rubber, based on the total weight of the material.

14. The radiation shielding material of claim 1 wherein the metal having radiation attenuating characteristics and the radiation shielding material are sufficiently heat resistant to withstand temperatures from about 220° F. to about 400° F.

15. The radiation shielding material of claim 1 which provides attenuation at an energy level of about 1,173 kV to about 1,332 kV.

16. The radiation shielding material of claim 1, wherein the radiation shielding material is in the form of a sheet having a thickness of at least 0.1 inches.

17. The radiation shielding material of claim 1, wherein said radiation shielding material has a tensile strength of about 200 to about 800 lbs/in$^2$ according to ASTM D412, and a tear strength of 40 to 140 lbs/in according to ASTM D624, die B.

18. The radiation shielding material of claim 17, wherein said radiation shielding material has a tensile strength of about 400 to about 600 lbs/in$^2$ according to ASTM D412, and a tear strength of 75 to 105 lbs/in according to ASTM D624, die B.

19. The radiation shielding material of claim 1, wherein said radiation shielding material has a minimum Shore A durometer hardness of 60 according to ASTM D2240.

20. The radiation shielding material of claim 1, wherein said radiation shielding material includes fabric material securely attached to at least one side of the radiation shielding material.

21. The radiation shielding material of claim 20, wherein the fabric material comprises cotton fibers, synthetic fibers, fiberglass fibers, aramid fibers, or Kevlar fibers.

22. The radiation shielding material of claim 1, wherein said radiation shielding material has a thickness of from about 0.125 inches to about 1.0 inches.

23. The radiation shielding material of claim 22, wherein said radiation shielding material has a thickness of from about 0.125 inches to about 1.0 inches.

24. The radiation shielding material of claim 23, wherein said radiation shielding material has a thickness of from about 0.125 inches to about 0.75 inches.

25. The radiation shielding material of claim 24, wherein said radiation shielding material has a thickness of from about 0.125 inches to about 0.5 inches.

26. A method for shielding a radiation emitting area comprising:

providing a radiation shielding material comprising: a silicone rubber and an effective amount of a metal having radiation attenuation characteristics;

shielding the radiation emitting area with the radiation shielding material having an effective thickness sufficient for blocking a desired percentage of the radiation;

wherein said metal having radiation attenuation characteristics comprises particles, wherein at least 60% of said particles have diameters of less than 100 micrometers and wherein the average particle size is in the range of about 0.4 micrometers to about 45 micrometers; and wherein said radiation shielding material has a minimum Shore A durometer hardness of 50 according to ASTM D2240.

27. The method of claim 26, wherein at least 75% of said particles have diameters of less than 100 micrometers.

28. The method of claim 26, wherein at least about 99% of said particles have diameters of less than 100 micrometers.

29. The method of claim 26, wherein said metal having radiation attentuating characteristics comprises at least one of tungsten, bismuth, and stainless steel.

30. The method of claim 26, wherein said silicone rubber comprises dimethyl silicone rubber, phenyl methyl silicone rubber, phenyl silicone rubber, polyvinylsilicone rubber, fluorosilicone rubber, or polydimethylsilicone based elastomer.

31. The method of claim 26, wherein the radiation shielding material further comprises a reinforcing filler and processing aids.

32. The method of claim 26, wherein the metal having radiation attenuating characteristics is tungsten or bismuth.

33. The method of claim 26, wherein the metal having radiation attenuating characteristics is tungsten.

34. The method of claim 26, wherein the radiation shielding material comprises from about 65 percent by weight to about 95 percent by weight of the metal having radiation attenuating characteristics, based on the total weight of the radiation shielding material, and from about 5 to about 35 percent by weight of the silicone rubber based on the total weight of the radiation shielding material.

35. The method for shielding a radiation emitting area of claim 26, wherein said radiation shielding material has a tensile strength of about 200 to about 800 lbs/in$^2$ according to ASTM D412, and a tear strength of 40 to 140 lbs/in according to ASTM D624, die B.

36. The method for shielding a radiation emitting area of claim 35, wherein said radiation shielding material has a tensile strength of about 400 to about 600 lbs/in$^2$ according to ASTM D412, and a tear strength of 75 to 105 lbs/in according to ASTM D624, die B.

37. The method for shielding a radiation emitting area of claim 26, wherein said radiation shielding material has a minimum Shore A durometer hardness of 60 according to ASTM D2240.

38. The method for shielding a radiation emitting area of claim 26, wherein said radiation shielding material includes fabric material securely attached to at least one side of the radiation shielding material.

39. The method for shielding a radiation emitting area of claim 38, wherein the fabric material comprises cotton fibers, synthetic fibers, fiberglass fibers, aramid fibers, or Kevlar fibers.

40. The method for shielding a radiation emitting area of claim 26, wherein said radiation shielding material has a thickness of from about 0.125 inches to about 1.0 inches.

41. The method for shielding a radiation emitting area of claim 40, wherein said radiation shielding material has a thickness of from about 0.125 inches to about 1.0inches.

42. The method for shielding a radiation emitting area of claim 41, wherein said radiation shielding material has a thickness of from about 0.125 inches to about 0.75 inches.

43. The method for shielding a radiation emitting area of claim 42, wherein said radiation shielding material has a thickness of from about 0.125 inches to about 0.5 inches.

44. A radiation shielding material comprising:

an effective amount of a silicone elastomer;

an effective amount of a metal having radiation attenuating characteristics wherein said metal having radiation attenuating characteristics comprises particles, wherein at least 60% of said particles have diameters of less than 100 micrometers and wherein the average particle size is in the range of about 0.4 micrometers to about 45 micrometers; and wherein said radiation shielding material has a minimum Shore A durometer hardness of 50 according to ASTM D2240.

45. The radiation shielding material of claim 44, wherein said metal having radiation attenuating characteristics is selected from the group consisting of tungsten, bismuth, and stainless steel.

46. The radiation shielding material of claim 44, wherein said silicone elastomer includes one or more methyl, vinyl, phenyl, or trifluoropropyl side or pendant groups along the Si—O polymer chain.

47. The radiation shielding material of claim 44, wherein said silicone elastomer is a polydimethylsilicone based elastomer.

48. The radiation shielding material of claim 44, wherein said metal having radiation attenuating characteristics includes tungsten, bismuth, or stainless steel.

49. The radiation shielding material of claim 44, further comprising a reinforcing filler and processing aids.

50. The radiation shielding material of claim 44, wherein the metal having radiation attenuating characteristics is tungsten or bismuth.

51. The radiation shielding material of claim 44, wherein the metal having radiation attenuating characteristics is tungsten.

52. The radiation shielding material of claim 44, wherein the radiation shielding material comprises from about 65 percent by weight to about 95 percent by weight of the metal having radiation attenuating characteristics, based on the total weight of the material, and from about 5 to about 35 percent by weight of the silicone elastomer, based on the total weight of the material.

53. The radiation shielding material of claim 44, further comprising heat and corrosion resistant metals.

54. The radiation shielding material of claim 44, wherein said silicone rubber comprises dimethyl silicone rubber, phenyl methyl silicone rubber, phenyl silicone rubber, polyvinylsilicone rubber, fluorosilicone rubber, or polydimethylsilicone based elastomer.

55. The radiation shielding material of claim 44, wherein the radiation shielding material is in the form of a sheet having a thickness of at least 0.1 inches.

56. The radiation shielding material of claim 44, wherein said radiation shielding material has a tensile strength of about 200 to about 800 lbs/in$^2$ according to ASTM D412, and a tear strength of 40 to 140 lbs/in according to ASTM D624, die B.

57. The radiation shielding material of claim 56, wherein said radiation shielding material has a tensile strength of about 400 to about 600 lbs/in$^2$ according to ASTM D412, and a tear strength of 75 to 105 lbs/in according to ASTM D624, die B.

58. The radiation shielding material of claim 44, wherein said radiation shielding material has a minimum Shore A durometer hardness of 60 according to ASTM D2240.

59. A radiation shielding material comprising:

an effective amount of rubber;

an effective amount of a radiation attenuating metal; and wherein said radiation shielding material is in the form of a sheet having a thickness of at least 0.1 inches, and said radiation attenuating metal comprising particles of tungsten, wherein at least 60% of said tungsten particles have diameters of less than 100 micrometers; and wherein said radiation shielding material has a minimum Shore A durometer hardness of 50 according to ASTM D2240.

60. The radiation shielding material of claim 59, wherein said radiation shielding material has a tensile strength of about 200 to about 800 lbs/in$^2$ according to ASTM D412, and a tear strength of 40 to 140 lbs/in according to ASTM D624, die B.

61. The radiation shielding material of claim 60, wherein said radiation shielding material has a tensile strength of about 400 to about 600 lbs/in$^2$ according to ASTM D412, and a tear strength of 75 to 105 lbs/in according to ASTM D624, die B.

62. The radiation shielding material of claim 59, wherein said radiation shielding material has a minimum Shore A durometer hardness of 60 according to ASTM D2240.

63. A radiation shielding material comprising:

an effective amount of rubber;

an effective amount of a radiation attenuating metal; and wherein said radiation shielding material is in the form of a sheet having a thickness of at least 0.1 inches, and said radiation attenuating metal comprising particles, wherein at least 60% of said particles have diameters of less than 100 micrometers and wherein said particles are dispersed within said rubber to form a substantially homogeneous radiation shielding material; and wherein said radiation shielding material has a minimum Shore A durometer hardness of 50 according to ASTM D2240.

64. The radiation shielding material of claim 63, wherein said radiation shielding material has a tensile strength of about 200 to about 800 lbs/in$^2$ according to ASTM D412, and a tear strength of 40 to 140 lbs/in according to ASTM D624, die B.

65. The radiation shielding material of claim 64, wherein said radiation shielding material has a tensile strength of about 400 to about 600 lbs/in$^2$ according to ASTM D412, and a tear strength of 75 to 105 lbs/in according to ASTM D624, die B.

66. The radiation shielding material of claim 63, wherein said radiation shielding material has a minimum Shore A durometer hardness of 60 according to ASTM D2240.

* * * * *